US006443219B1

(12) United States Patent
Sasai et al.

(10) Patent No.: US 6,443,219 B1
(45) Date of Patent: Sep. 3, 2002

(54) METHOD FOR CASTING MOLTEN METAL

(75) Inventors: Katsuhiro Sasai; Eiichi Takeuchi; Hiroshi Harada; Hajime Hasegawa; Takehiko Toh; Keisuke Fujisaki, all of Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/367,183

(22) PCT Filed: Dec. 8, 1998

(86) PCT No.: PCT/JP98/05550

§ 371 (c)(1),
(2), (4) Date: Aug. 9, 1999

(87) PCT Pub. No.: WO99/29452

PCT Pub. Date: Jun. 17, 1999

(30) Foreign Application Priority Data

Dec. 8, 1997 (JP) ..... 9-337195
Dec. 17, 1997 (JP) ..... 9-348151

(51) Int. Cl.[7] ..... B22D 27/02
(52) U.S. Cl. ..... 164/466; 164/468
(58) Field of Search ..... 164/466, 467, 164/468, 502, 504

(56) References Cited

U.S. PATENT DOCUMENTS

| | | | | | |
|---|---|---|---|---|---|
| 4,852,635 | A | * | 8/1989 | Onishi et al. | 164/468 |
| 4,933,005 | A | * | 6/1990 | Mulcahy et al. | 75/10.16 |
| 5,085,265 | A | * | 2/1992 | Yamamoto et al. | 164/468 |
| 5,279,351 | A | * | 1/1994 | Metz | 164/468 |
| 5,307,863 | A | * | 5/1994 | Kubota et al. | 164/466 |
| 5,699,850 | A | * | 12/1997 | Beitelman et al. | 164/468 |
| 5,722,480 | A | * | 3/1998 | Asai et al. | 164/466 |
| 5,746,268 | A | * | 5/1998 | Fujisaki et al. | 164/468 |
| 6,003,590 | A | * | 12/1999 | Pavicevic et al. | 164/468 |
| 6,024,161 | A | * | 2/2000 | Fujioka et al. | 164/413 |

FOREIGN PATENT DOCUMENTS

| | | | | |
|---|---|---|---|---|
| JP | 49-129632 | | 12/1974 | |
| JP | 50-23338 | | 3/1975 | |
| JP | 50-90529 | | 7/1975 | |
| JP | 54-125132 | | 9/1979 | |
| JP | 60-102263 | | 6/1985 | |
| JP | 63-188451 | * | 8/1988 | B22D/11/04 |
| JP | 64-66055 | * | 3/1989 | B22D/11/10 |
| JP | 64-71557 | | 3/1989 | |
| JP | 64-83350 | * | 3/1989 | B22D/11/10 |
| JP | 2-37946 | * | 2/1990 | B22D/11/10 |
| JP | 3-44858 | | 7/1991 | |
| JP | 5-237611 | | 9/1993 | |
| JP | 5-318064 | * | 12/1993 | B22D/11/10 |
| JP | 6-182497 | * | 7/1994 | B22D/11/04 |
| JP | 7-164119 | * | 6/1995 | B22D/11/10 |
| JP | 9-182941 | * | 7/1997 | B22D/11/10 |

* cited by examiner

*Primary Examiner*—M. Alexandra Elve
*Assistant Examiner*—Kevin P. Kerns
(74) *Attorney, Agent, or Firm*—Kenyon & Kenyon

(57) ABSTRACT

The present invention provides a continuous casting method in which vibration is given to molten metal by a shifting magnetic field so that the equi-axed crystal ratio can be enhanced and the equi-axed crystals can be made fine without generating surface defects caused by powder trapping. Further, the present invention provides an apparatus to which the continuous casting method is applied. Furthermore the present invention provides a cast slab produced by the above method and apparatus. The method of casting molten metal comprises the following steps: pouring molten metal into a mold and solidifying it in the mold while applying an electromagnetic force, which is generated by an electromagnetic coil arranged in the proximity of a molten metal pool in the mold, upon the molten metal; and vibrating the molten metal, which has been solidified in the mold while being cooled and solidified, by a shifting magnetic field generated by the electromagnetic coil so that the molten metal is accelerated by a high intensity and a low intensity of acceleration in a range not exceeding a predetermined flow velocity when the directional vectors of high acceleration and low acceleration in the same direction or in the opposite direction are combined with each other.

21 Claims, 9 Drawing Sheets

METHOD FOR CASTING MOLTEN METAL

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

1. Field of the Invention

The present invention relates to a method of casting molten steel when molten steel is vibrated by the action of an electromagnetic coil. Also the present invention relates to a continuous casting apparatus for the method of casting molten steel and a cast slab which has been cast by the method and the apparatus. More particularly, the present invention relates to a method of casting molten steel, an apparatus for the method of casting molten steel and a cast slab which has been cast by the method and the apparatus, characterized in that: gas and powder trapping caused in molten metal in the process of solidification of the molten metal in a mold can be prevented; cracks on a surface of the cast slab caused when the temperature is not uniform can be prevented; and further the inner structure of the cast slab can be made fine.

2. Description of the Prior Art

As a method for making a solidification structure to be equi-axed crystal so that segregation caused in the process of solidification can be reduced, in continuous casting of steel, electromagnetic stirring is widely used. For example, this technique is disclosed in Japanese Unexamined Patent Publication (Kokai) No. 50-23338. It is possible to obtain an equi-axed structure when molten steel in the proximity of a solidification interface is forcibly given a fluidity by electromagnetic stirring so that prismatic dendrites can be cut apart. In order to enhance an equi-axed crystal ratio, various investigations have been made into the condition of electromagnetic stirring until now and segregation has been somewhat reduced.

However, according to the conventional electromagnetic stirring generated in a mold, an equi-axed crystal ratio by which a sufficiently high quality of product can be produced is not necessarily obtained in the case of producing a type of steel (for example, a type of steel, the carbon content of which is not more than 0.1%) in which it is difficult to form an equi-axed crystal structure. In order to enhance the equi-axed crystal ratio of the above type of steel, in which it is difficult to form an equi-axed crystal structure, it can be considered to increase the thrust of electromagnetic stirring generated in a mold. However, when this method is adopted, a surface velocity of molten steel in the mold is increased, and powder trapping is caused on the surface of molten steel. As a result, a defect is caused on the surface of the product. In some types of steel in which the occurrence of segregation is severely restricted, it is impossible to meet the demand of quality only when the equi-axed crystal ratio is enhanced. In these types of steel, the grain size of the equi-axed crystal structure must be made further fine.

Conventionally, the following technique is reported, for example, the following technique is disclosed in the U.S. Pat No. 5,722,480. Pulse waves, which are generated by turning on and off an electric current, are given in an alternating static magnetic field so that an electromagnetic force directed to the center of a mold side wall is generated. By this electromagnetic force, a lubricating effect and a soft contacting effect can be provided. However, according to the above method, the electric current is not always made to flow, and an acceleration of the vibrating waves is not controlled. Japanese Unexamined Patent Publication (Kokai) No. 9-182941 discloses a method in which a stirring direction of the electromagnetic stirring is periodically inverted so that a downward flow cannot be developed and diffusion of inclusion to a lower portion can be prevented. However, according to this method, vibrating waves are not given onto the front solidified shell by a shifting magnetic field. Also, it is not a method in which acceleration is controlled so that the solidification structure can be made fine, inclusion can be eliminated for purification and the meniscus can be stabilized.

Further, according to a method disclosed in Japanese Unexamined Patent Publication (Kokai) No. 64-71557, an electromagnetic coil for generating a magnetic field to rotate molten metal on a horizontal surface is alternated so that it can exist in a static condition. Therefore, a flow velocity of the meniscus is zero in this method. According to a method disclosed in Japanese Examined Patent Publication (Kokoku) No. 3-44858, in order to prevent V-segregation and porosity of a cast slab, in an electromagnetic stirring in which a circulation current is caused on a plane perpendicular to a direction in which a cast slab is drawn out, a stirring direction is inverted at intervals of 10 to 30 seconds. According to a method disclosed in Japanese Unexamined Patent Publication (Kokai) No. 54-125132, the casting temperature is prescribed for preventing ridging of stainless steel and, in order to prevent positive and negative segregation caused in electromagnetic stirring, a ratio of two electric currents, the phases of which are different from each other, is prescribed, and a direction of electric current is switched and an electric current is made to flow in a predetermined direction for 5 to 50 seconds.

Further, according to Japanese Unexamined Patent Publication (Kokai) No. 60-102263, in order to prevent the occurrence of defects caused in casting steel of 9%-Ni which is used for a thick plate at low temperatures, alternating time of electromagnetic stirring is set at 10 to 30 seconds.

In the above techniques, alternating stirring is conducted in a relatively long period. That is, the above techniques are entirely different from a technique in which vibrating waves are given onto the front solidified shell by a shifting magnetic field and acceleration of the vibrating waves is controlled.

Therefore, it is desired to develop a new technique by which the above problems are solved, the solidification structure is made fine, inclusion is purified and further the meniscus is stabilized.

SUMMARY OF THE INVENTION

An object of the present invention is to solve the above problems caused in the conventional electromagnetic stirring generated in a mold. That is, it is an object of the present invention to provide a continuous casting method in which vibration is given by a shifting magnetic field so that the equi-axed crystal ratio can be enhanced without the occurrence of surface defects caused by powder trapping and the equi-axed crystal structure itself can be further made fine. Further, it is an object of the present invention to provide a continuous casting apparatus to which the above continuous casting method is applied, and also it is an object of the present invention to provide a cast slab produced by the above method and an apparatus.

It is another object of the present invention to solve problems caused in the casting method in which an electromagnetic force is given to molten metal so that solidification of molten metal can be stabilized and the surface property of a cast slab can be improved.

The summary for the present invention to accomplish the above objects is described as follows.

(1) A method for casting molten metal comprising the steps of: pouring molten metal into a mold and solidifying it in the mold while applying an electromagnetic force, which is generated by an electromagnetic coil arranged in proximity to a molten metal pool in the mold, upon the molten metal; and vibrating the molten metal, which has been solidified in the mold or is being drawn out downward from the mold while being cooled and solidified, by a shifting magnetic field generated by the electromagnetic coil so that the molten metal is alternately given a high intensity and a low intensity of acceleration.

(2) A method for casting molten metal comprising the steps of: pouring molten metal into a mold and solidifying it in the mold while applying an electromagnetic force, which is generated by an electromagnetic coil arranged in the proximity of a molten metal pool in the mold, upon the molten metal; and vibrating the molten metal periodically, which has been solidified in the mold or is being drawn out downward from the mold while being cooled and solidified, by a shifting magnetic field generated by the electromagnetic coil so that the molten metal is alternately given a high intensity and a low intensity of acceleration.

(3) A method for casting molten metal comprising the steps of: pouring molten metal into a mold and solidifying it in the mold while applying an electromagnetic force, which is generated by an electromagnetic coil arranged in the proximity of a molten metal pool in the mold, upon the molten metal; and vibrating the molten metal, which has been solidified in the mold or is being drawn out downward from the mold while being cooled and solidified, by a shifting magnetic field generated by the electromagnetic coil so that the molten metal is accelerated by a high intensity and a low intensity of acceleration in a range not exceeding a predetermined flow velocity when the directional vectors of high acceleration and low acceleration in the same direction or in the opposite direction are combined with each other.

(4) A method for casting molten metal comprising the steps of: pouring molten metal into a mold and solidifying it in the mold while applying an electromagnetic force, which is generated by an electromagnetic coil arranged in the proximity of a molten metal pool in the mold, upon the molten metal; and vibrating the molten metal periodically in the one direction and the opposite direction, which has been solidified in the mold or is being drawn out downward from the mold while being cooled and solidified, by a shifting magnetic field generated by the electromagnetic coil.

(5) A method for casting molten metal according to any one of items (1) to (4), wherein a process conducted in the mold is a cooling and solidifying process, and also the process conducted in the mold is a continuous casting process for continuously casting a slab, bloom, slab of medium thickness, or billet.

(6) A method for casting molten metal according to any one of items (1) to (5), wherein a high intensity of acceleration of the vibrating waves in the one direction and the opposite direction is not lower than 10 $cm/s^2$ and a low intensity of acceleration of the vibrating waves in the one direction and the opposite direction is lower than 10 $cm/s^2$.

(7) A method for casting molten metal according to item (6), wherein an acceleration and an acceleration time of the vibrating waves in the one direction, or an acceleration and an acceleration time of the vibrating waves in the opposite direction, and a coefficient of acceleration time (acceleration×acceleration time) satisfy the following expression:

$$50\ cm/s \leqq \text{coefficient of acceleration time}$$

(8) A method for casting molten metal according to item (6), wherein an acceleration and an acceleration time of the vibrating waves in the one direction, or an acceleration and an acceleration time of the vibrating waves in the opposite direction, and a coefficient of acceleration time (acceleration×acceleration time) satisfy the following expressions.

$$10\eta \leqq \text{coefficient of acceleration time}$$

$\eta$: viscosity (cp) of molten metal (9) A method for casting molten metal according to item (6), wherein a relation between carbon content [C ] and acceleration satisfies the following expressions.

| | |
|---|---|
| $[C] < 0.1\%$ | $30\ cm/s^2 \leqq$ acceleration |
| $0.1\% \leqq [C] < 0.35\%$ | $-80[C] + 38\ cm/s^2 \leqq$ acceleration |
| $0.35\% \leqq [C] < 0.5\%$ | $133.3[C] - 36.7\ cm/s^2 \leqq$ acceleration |
| $0.5\% \leqq [C]$ | $30\ cm/s^2 \leqq$ acceleration |

(10) A method for casting molten metal according to any one of items (1) to (5), wherein an acceleration stop time or an electric power stop time, the period of which is not more than 0.3 sec and not less than 0.03 sec, is provided in the process of acceleration in the one direction and in the process of acceleration in the opposite direction.

(11) A method for casting molten metal according to item (6), (7), (8) or (9), wherein an acceleration stop time or an electric power stop time, the period of which is not more than 0.3 sec and not less than 0.03 sec, is provided in the process of acceleration in the one direction and also in the process of acceleration in the opposite direction.

(12) A method for casting molten metal according to item (6), (7), (8) or (9), wherein acceleration is generated for t1, subsequently a constant flow velocity is kept for t2, next acceleration is generated in the opposite direction for t3 and thereafter a constant flow velocity is kept for t4 in one period, and molten metal in the mold is periodically vibrated by repeating this period, and a vibration time t1+t2+t3+t4 in one period is determined to be not less than 0.2 sec and less than 10 sec.

(13) A method for casting molten metal according to any one of items (1) to (8) or item (9), wherein the molten metal is periodically vibrated, and a rotating flow in the one direction and the opposite direction is given to the molten metal.

(14) A method for casting molten metal according to item (13), characterized in that: when integration is generated for a certain period of time, the expression of integrated value of (acceleration time×acceleration) in the one direction>integrated value of (acceleration time× acceleration) in the opposite direction is satisfied; and an average rotating flow velocity caused by the difference between the integrated values is not more than 1 m/s.

(15) A method for casting molten metal according to item (13), wherein acceleration of the molten metal in the mold is conducted for t1, subsequently a constant flow velocity is kept for t2, next acceleration is generated in the opposite direction for t3 and thereafter a constant flow velocity is kept for t4 in one period, molten metal in the mold is periodically vibrated by repeating the period, t1*a* is a time until the vibrating flow velocity becomes zero in time t1, t1*b* is a time after the vibrating flow velocity becomes zero in time t1, an expression of t1*b*+t2>t4+t1*a* is satisfied, and a rotating flow velocity in one direction caused by the difference in time is not more than 1 m/s.

(16) A method for casting molten metal according to item (13), wherein vibration is periodically given in a period of n cycles, a rotating flow is generated by giving acceleration only in a predetermined direction for the rotating time ΔTv after the vibration, and an average rotating flow velocity, number n of cycles and rotating time ΔTv satisfy the following expressions.

Average rotating flow velocity ≦1 m/s

1≦number n of cycles≦20

0.1≦rotating time ΔTv≦5 sec

(17) A method for casting molten metal according to item (13), wherein a rotating flow is generated by increasing an acceleration in the one direction to be larger than an acceleration in the opposite direction, and an average rotating flow rate is not more than 1 m/s.

(18) A method for casting molten metal according to item (13), wherein an electric current for rotation generating a rotating flow in one direction is further superimposed on an electric current during vibration by an electric current of the electromagnetic coil for generating a shifting magnetic field so that an average rotating flow velocity can be not more than 1 m/s.

(19) A method for casting molten metal according to any one of items (1) to (9), wherein the molten metal is periodically vibrated, and vibration of a short period is further added, and the frequency of the vibration of this short period is not less than 100 Hz and not more than 30 KHz.

(20) A method for casting molten metal according to any one of items (6) to (9), wherein an electromagnetic coil is arranged in the mold or in the proximity of the molten metal pool in the mold when molten metal is poured into and solidified in the mold, the molten metal in the mold is periodically vibrated in the one direction and the opposite direction by a shifting magnetic field generated by the electromagnetic coil, and an electromagnetic brake, which is arranged in a range from the meniscus to a position under the mold distant by 1 m, is applied.

(21) A method for casting molten metal according to item (11), wherein an electromagnetic coil is arranged in proximity to the molten metal pool in the mold when molten metal is poured into and solidified in the mold, the molten metal in the mold is periodically vibrated in the one direction and the opposite direction by a shifting magnetic field generated by the electromagnetic coil, and an electromagnetic brake, which is arranged at a position under the mold distant from the meniscus by 1 m, is applied being synchronized with time at which acceleration of the electromagnetic coil is stopped in the mold or being synchronized with time at which an electric power source is stopped.

(22) A method for casting molten metal according to any one of items (6) to (15), wherein the electromagnetic coil arranged in proximity to the molten metal pool in the mold is arranged in a range under the mold from right below the mold to a position distant from the mold by 10 m.

(23) A method for casting molten metal according to item (22), wherein an electromagnetic brake, which is arranged in a range from a position above the electromagnetic coil distant by 1 m to a position below the electromagnetic coil distant by 1 m, is applied.

(24) A method for casting molten metal according to item (11), wherein the electromagnetic coil arranged in proximity to the molten metal pool in the mold is arranged in a range from a position right below the mold to a position under the mold distant by 10 m, and the electromagnetic brake arranged in a range from the meniscus to a position under the mold distant by 1 m is applied being synchronized with the time at which acceleration of the electromagnetic coil is stopped in the mold or being synchronized with the time at which the electric power source is stopped.

(25) An electromagnetic coil device used for any one of items (1) to (24), comprising: an electromagnetic drive device for periodically vibrating in the one direction and the opposite direction; and a control unit for controlling the electromagnetic drive device.

(26) An electromagnetic coil device used for one of items (1) to (24) comprising; an electromagnetic coil; and an electric power source for supplying an electric current to vibrate the electromagnetic coil periodically in the one direction and the opposite direction or a waveform generating device.

(27) An electromagnetic coil device used for one of items (1) to (24), comprising: an electromagnetic drive device for vibrating molten metal periodically in the one direction and the opposite direction, the electromagnetic drive device having a function of raising an electric current to a command value in the case of changing a vibrating direction; and an electric current control device for controlling the electric current.

(28) An electromagnetic coil device comprising an electromagnetic drive device, a control device for controlling an electric current, and an electromagnetic brake used in any one of items (1) to (24).

(29) A cast slab having a negative segregation zone composed of a multilayer structure, the pitch of which is not more than 2 mm and the number of the layers of which is not less than three, a dendrite or a crystalline structure zone composed of a deflection structure of a multilayer.

(30) A cast slab having a negative segregation zone composed of a multilayer structure, the pitch of which is not more than 2 mm and the number of the layers of which is not less than three, a dendrite or a crystalline structure zone composed of a deflection structure of a multilayer, wherein the thickness of the negative segregation zone, dendrite or crystalline structure zone is not more than 30 mm.

(31) A cast slab characterized in that: a corner point (C) of a central negative segregation line (m) of a negative segregation zone of an average profile of the negative segregation zone of a multilayer structure is determined, or a virtual corner point (C') extrapolated from two adjoining sides of a central segregation line (m) of an arcuate negative segregation zone is determined; and parallel lines are drawn from points (E) on two adjoining sides, which are distant from the corner point to the inside of the cast slab by 5 mm, to the two adjoining sides, and a difference between shell thickness $D_1$ at a point of intersection (F) with the central segregation line (m) and shell thickness $D_2$ at the center in the cast slab width direction is not more than 3 mm.

(32) A cast slab characterized in that: a corner point of a center line of dendrite or a crystalline structure zone of deflection structure of a multilayer, which has an average profile thereof, is determined, or a virtual corner point extrapolated from two adjoining sides of a center line of the arcuate dendrite or crystalline structure zone is determined; and parallel lines are drawn from points on the two adjoining sides, which are distant from the corner point to the inside of the cast slab by 5 mm, to two adjoining sides, and a difference between shell thickness $D_1$ at a point of intersection with the central line and shell thickness $D_2$ at the center in the cast slab width direction is not more than 3 mm.

(33) A cast slab characterized in that: a shape of the cast slab is circular; and fluctuation of shell thickness at a point on a central segregation line (m) of a negative segregation zone of an average profile of the negative segregation zone of a multilayer structure is not more than 3 mm.

(34) A cast slab characterized in that: a shape of the cast slab is circular; and fluctuation of shell thickness at a point of a center line of a dendrite or a crystalline structure of an average profile of a dendrite structure or a crystalline structure zone of a deflection structure of a multilayer is not more than 3 mm.

(35) A cast slab provided when molten metal is poured into a mold and solidified while an electromagnetic force is applied to the molten metal by an electromagnetic coil arranged in the proximity of the mold according to item (31) or (33), the cast slab comprising a negative segregation zone composed of a multilayer structure formed in the inner circumferential direction of the mold having pitch P defined by the following expression (2) in a range of $D_0 \pm 15$ mm in the thickness direction with respect to solidified shell thickness $D_0$ (mm) at the core center in the casting direction determined by solidified shell thickness D (mm) defined by the following expression (1).

$$D=k(L/V)^n \quad (1)$$

D: Solidified shell thickness

L: Length from meniscus to core center of electromagnetic coil

V: Rate of casting k: Coefficient of solidification n: Constant $$P=U\times t/2 \quad (2)$$

U: Rate of solidification (dD/dt (mm/s))

t: Period of vibration

(36) A cast slab according to one of items (31) to (35), the cast slab having an equi-axed crystal ratio of not less than 50% on the inside of a negative segregation zone composed of a multilayer structure, on the inside of a dendrite or a crystalline structure zone composed of a multilayer-shaped deflection structure.

(37) A cast slab provided when molten metal is poured into a mold and solidified while an electromagnetic force is given to the molten metal by an electromagnetic coil arranged in the proximity of the mold according to item (32) or (34), the cast slab comprising a dendrite or a crystalline structure zone, the growing direction of which is regularly deflected, having pitch P defined by the following expression (2) in a range of $D_0 \pm 15$ mm in the thickness direction with respect to solidified shell thickness $D_0$ (mm) at the core center in the casting direction determined by solidified shell thickness D (mm) defined by the following expression (1).

$$D=k(L/V)^n \quad (1)$$

D: Solidified shell thickness

L: Length from meniscus to core center of electromagnetic coil

V: Rate of casting k: Coefficient of solidification n: Constant $$P=U\times t/2 \quad (2)$$

U: Rate of solidification (dD/dt (mm/s))

t: Period of vibration

BRIEF DESCRIPTION OF THE DRAWINGS

FIG. 2(*b*) is a diagram for explaining a pattern of a flow velocity of vibration on the front face of solidification.

FIG. 8(*b*) is a view showing a virtual corner in the case of an unclear negative segregation zone.

BEST MODE FOR CARRYING OUT THE INVENTION

Figure 1:
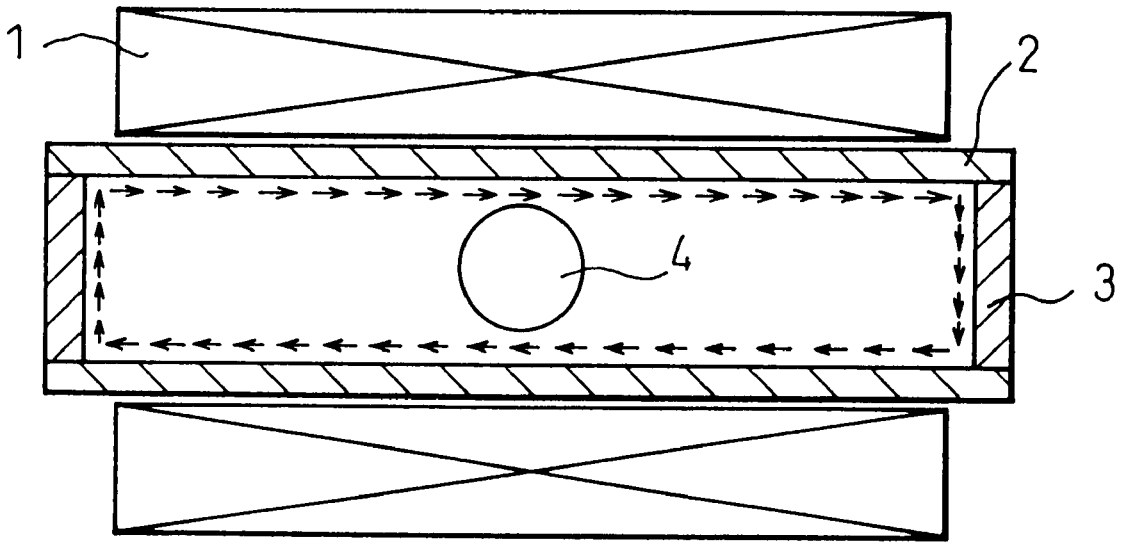
FIG. 1 is a view showing an outline of an arrangement of an electromagnetic coil in a mold according to the present invention.

FIG. 1 is a view showing the very moment of rotation of molten metal in a mold when an electromagnetic field is applied upon the molten metal by an electromagnetic coil of the present invention. In this connection, reference numeral 1 is an electromagnetic coil, reference numeral 2 is a side wall on the long side, reference numeral 3 is a side wall on the short side, and reference numeral 4 is an immersion nozzle.

Figure 7:
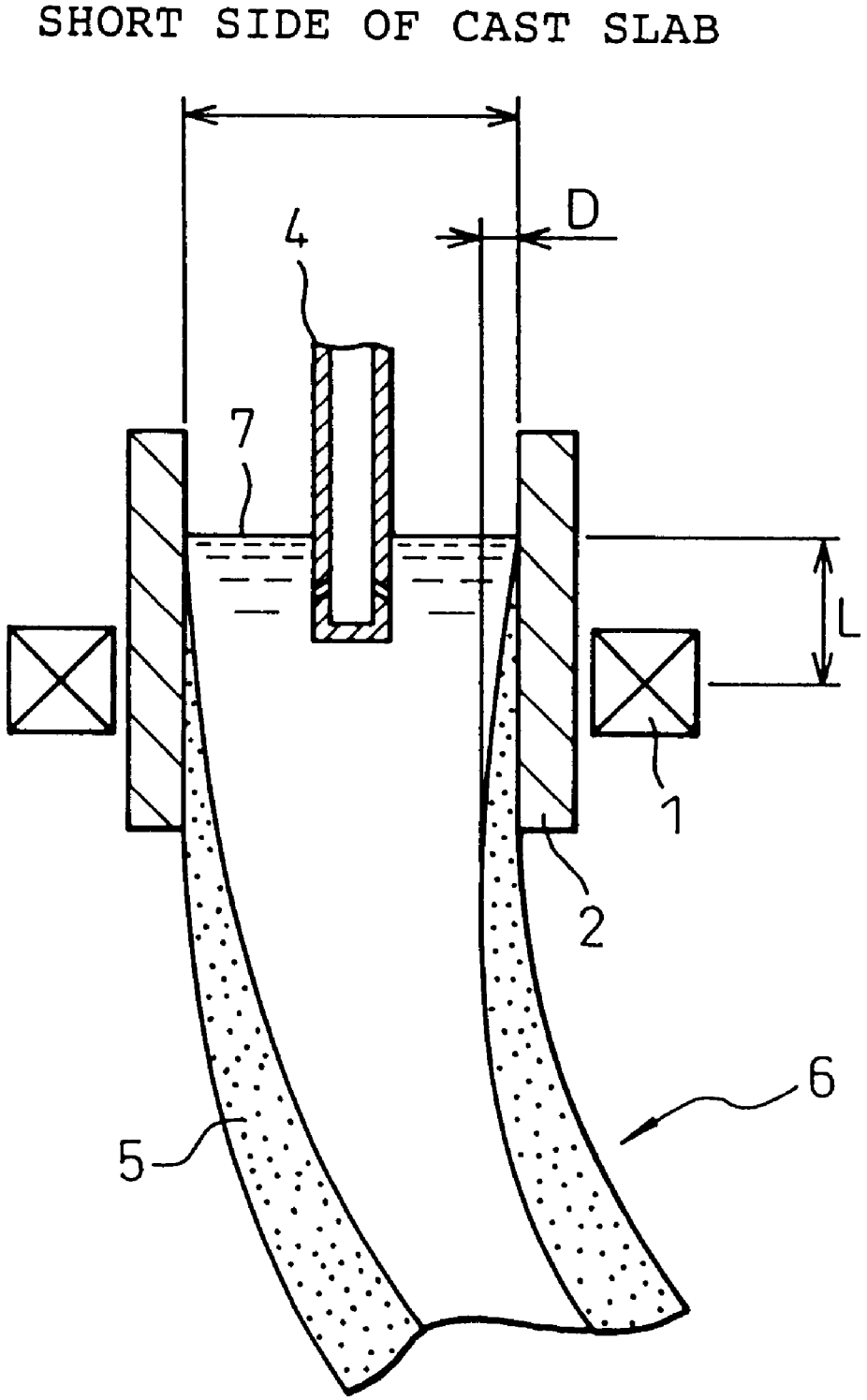
FIG. 7 is a schematic illustration showing an outline of thickness of a solidified shell at a core center in the casting direction of an electromagnetic coil.

FIG. 7 illustrates at 6 the solidification of the molten metal in the mold wherein 7 is the meniscus of the molten metal, 5 is the solidified shell, and D is the thickness of the solidified shell.

The first characteristic of the present invention is not only to rotate molten metal in the mold by generating a shifting magnetic field by the electromagnetic coil of the mold, but the first characteristic of the present invention is also to give an acceleration in the one direction and the opposite direction to molten metal by a shifting magnetic field so that the molten metal can vibrate on the front solidified shell. Further, an acceleration of this vibrating waves is controlled. The above technique is applied to not only a continuous casting process but also an ingot process in which a stationary mold is used. In this embodiment, a linear motor is used as the electromagnetic coil. However, the present invention is not limited to the specific embodiment. As long as a shifting magnetic field can be generated, any magnetic field generating device may be used, that is, a magnetic field generating device by which a linear magnetic field is generated is not necessarily used. For example, a magnetic field generating device by which a rotary magnetic field is generated may be used, and any magnetic field generating device by which vibration can be given to molten metal in the one direction and the opposite direction may be used.

The second characteristic of the present invention is that a load of the linear motor is increased in the one direction and the opposite rotation and an electric current is continuously supplied, so that a quick rise of the electric current can be accomplished. Due to the foregoing, an electromagnetic force can quickly reach a predetermined value. As a result, it becomes possible to control an acceleration given to molten metal in a wide range.

According to the above characteristics of the present invention, it is possible to remarkably enhance the inner quality and surface quality of a cast slab as follows. Instead of rotation of molten metal generated by a conventional electromagnetic stirring, vibrating waves generated by a shifting magnetic field is given onto a front solidified shell while an acceleration is being controlled in the present invention. Due to the foregoing, a prismatic cutting force is increased, so that the solidified structure can be made further finer, and at the same time, the inner quality of slab can be much purified. Further, a change in the meniscus can be suppressed to as small as possible, that is, an influence given to the meniscus shape disturbance can be suppressed to as small as possible. In this way, the inner and surface quality of a cast slab can be remarkably improved.

Figure 2A:
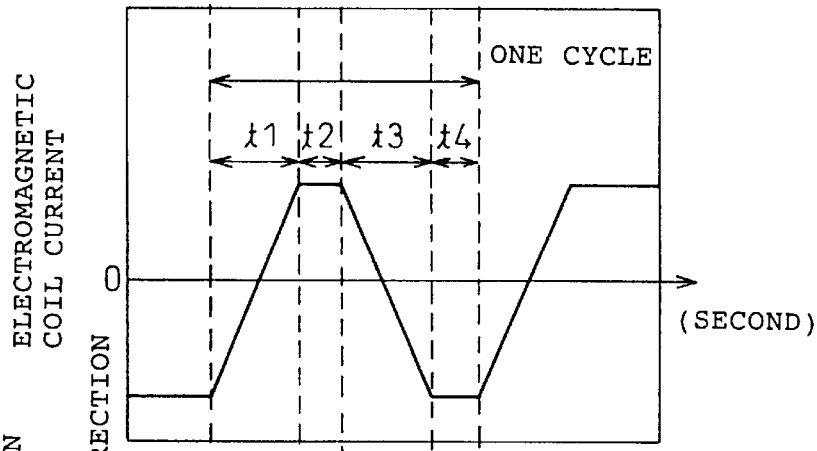
FIG. 2(*a*) is a diagram for explaining a pattern of an electric current of an electromagnetic coil of the present invention.
Figure 2B:
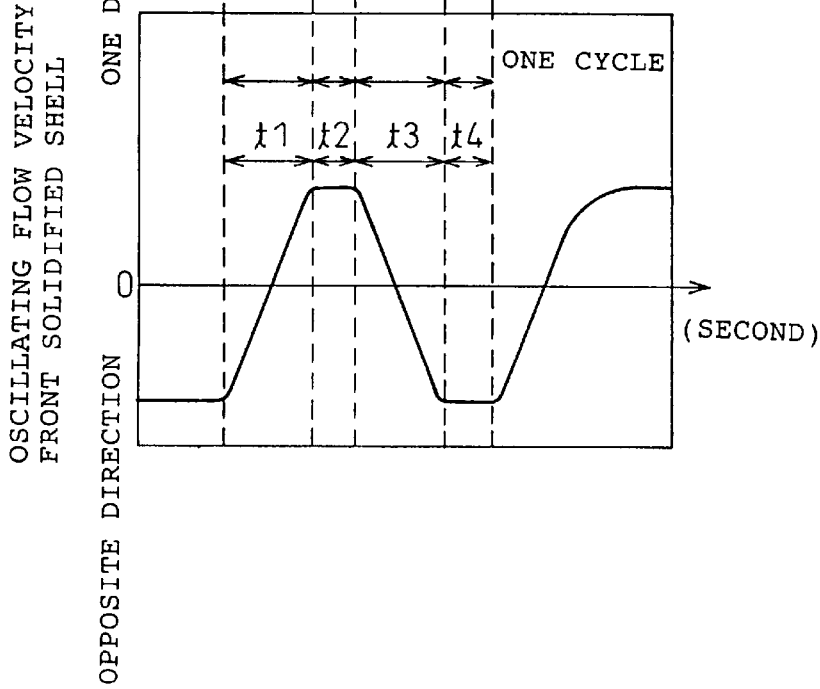

In general, a flow velocity of the conventional electromagnetic stirring conducted in continuous casting is 20 to 100 cm/s. The present inventors made investigation into a mechanism of generation of equi-axed crystals generated by the electromagnetic stirring in the above flow velocity range. As a result of the investigation, the following were made clear. Electromagnetic stirring has an effect of inclining a flow of prismatic dendrite onto an upstream side, however, an effect of cutting a prismatic dendrite apart, which has been conventionally considered to be high until now, is not so high. Instead of the effect of cutting the prismatic dendrite apart, heat transmission between a solidified shell and molten steel is facilitated by the electromagnetic stirring. Therefore, overheating of molten steel is reduced, so that solidification cores can be easily formed. On the basis of the above knowledge, the present inventors made further investigation into a method by which an effect of cutting the prismatic dendrite apart can be more remarkably enhanced as compared with the conventional method without impairing an effect of reducing overheat of molten steel when electromagnetic stirring is carried out. As a result of the investigation, the present inventors found the following. It is very effective that an electric current of the electromagnetic coil is periodically changed as shown in FIG. 2(*a*), so that vibrating waves, which reciprocate on the front face of solidification, are given to molten steel. Due to the foregoing, not only the equi-axed crystal ratio can be enhanced, but also the grain size of equi-axed crystals can be made fine.

When an electric current of the electromagnetic coil is changed according to the pattern shown in FIG. 2(*a*), a flow velocity of vibration on the front solidified shell follows the change in the electric current as shown in FIG. 2(*b*), wherein the curve shown in FIG. 2(*b*) becomes a little blunt compared with the curve shown in FIG. 2(*a*). In a region of t2 or t4 in which the flow velocity of vibration on the front solidified shell is constant, the vibration flow provides a small effect of cutting a prismatic dendrite apart. However, in an one direction accelerating region t1 and in an opposite direction accelerating region t3, an acceleration is generated in a vibrating flow on the front solidified shell. Therefore, compared with a rotational flow of a constant flow velocity, it is possible to give a very strong force to a prismatic dendrite. By the above effect, it is possible to remarkably enhance an effect of cutting the prismatic dendrite apart. Further, when the vibrating flow velocity on the front solidified shell is made to be the same as that of the conventional method in the region of t2, it is possible to provide an effect of reducing overheat of molten steel by facilitating a heat transmission between the solidification shell and molten steel. Since a sufficiently strong force to cut a prismatic dendrite apart is given onto the front solidified shell in the accelerating regions t1 and t3, the present invention has an effect of cleaning by which inclusion is prevented from being caught by the front solidified shell.

According to the conventional method, a large quantity of inclusion is caught by the surface layer of a cast slab, the solidification rate of which is high, and the degree of purification is deteriorated. However, according to the present invention, an average oxygen concentration in a region of 20 mm from the surface of a cast slab which was cast according to the present invention can be made lower than that of the inner portion of the slab. The rotating flow generated by the conventional electromagnetic stirring causes the problem of an unstable meniscus. When the rotating flow velocity is increased in order to enhance an equi-axed crystal ratio, powder trapping is caused, and further, the rotating flow collides with a side wall on the short side of the mold, so that a strong descending flow is continuously generated. However, when the vibrating waves, which reciprocate on the front solidified shell, are given to molten steel, it is possible to prevent the occurrence of disturbance of the meniscus and powder trapping, and further it is possible to suppress an influence of the descending flow. Accordingly, casting can be stably conducted.

In addition to that, when the rotating flow is superimposed on the vibrating waves, the purification of inclusion and the generation of cores can be further facilitated while a shape of the meniscus is stabilized. According to the conventional electromagnetic stirring, a negative segregation zone of solute elements is generated. Therefore, it is impossible to ensure the quality of a cast slab. However, according to the present invention, the vibrating waves reciprocate on the front solidified shell. Therefore, very thin negative segregation zones of a multilayer structure are generated. Accordingly, the negative segregation zones are dispersed, and the solidified structure can be made fine, and at the same time the negative segregation can be prevented.

Figure 8A:
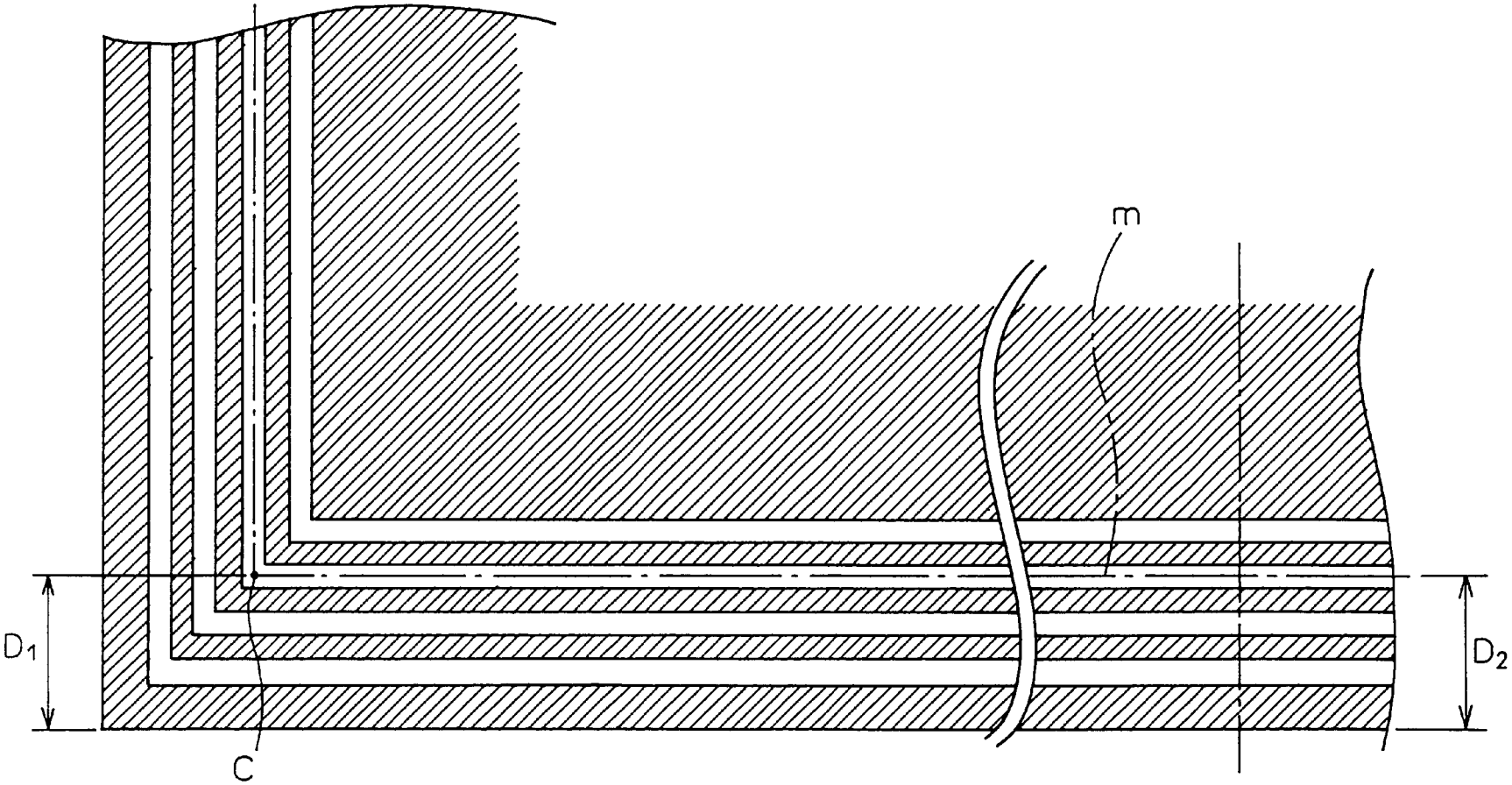
FIG. 8(*a*) is a view showing a typical example of a clear corner of a negative segregation zone of a cast slab of the present invention.
Figure 8B:
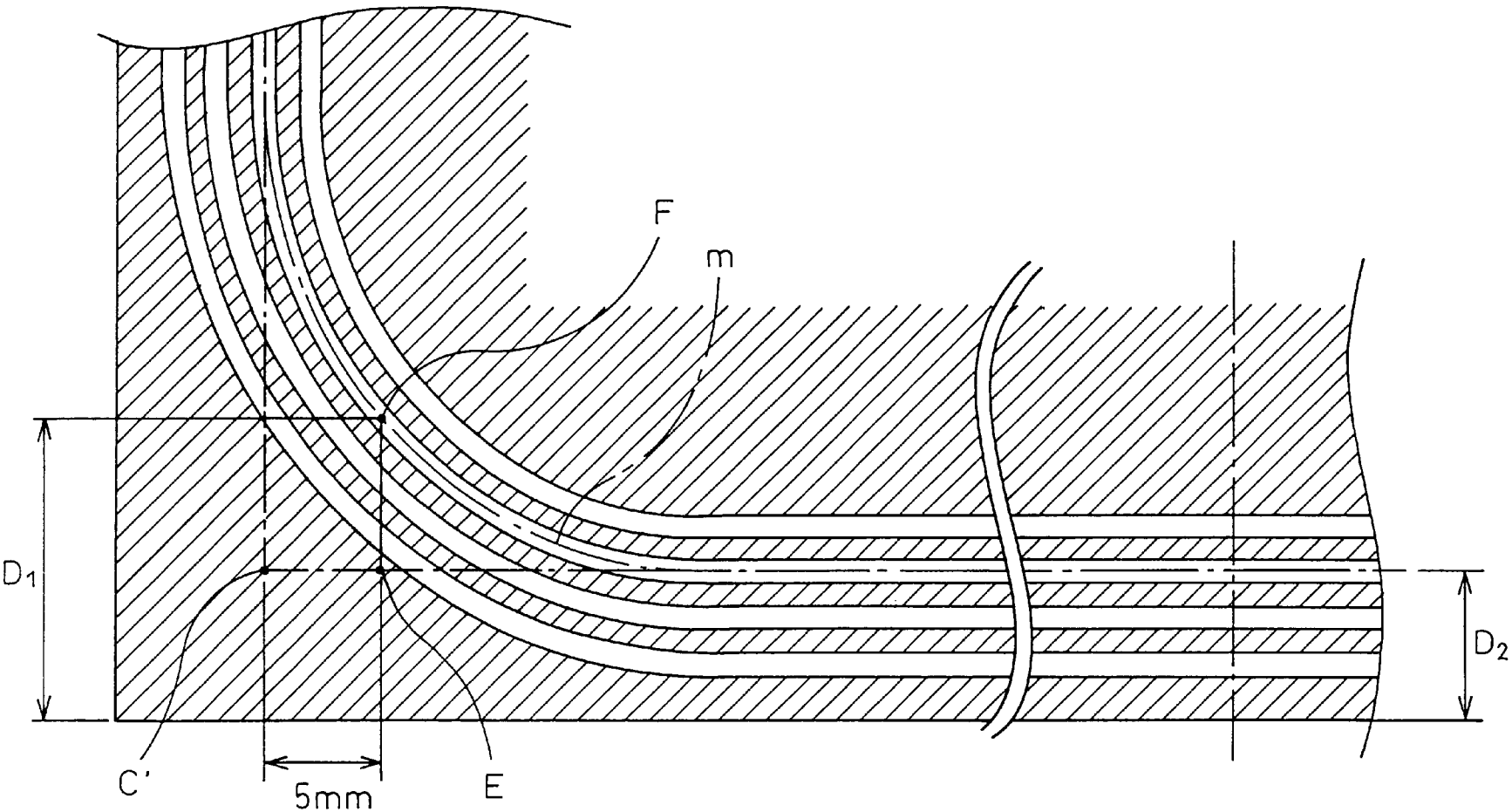
Figure 9:
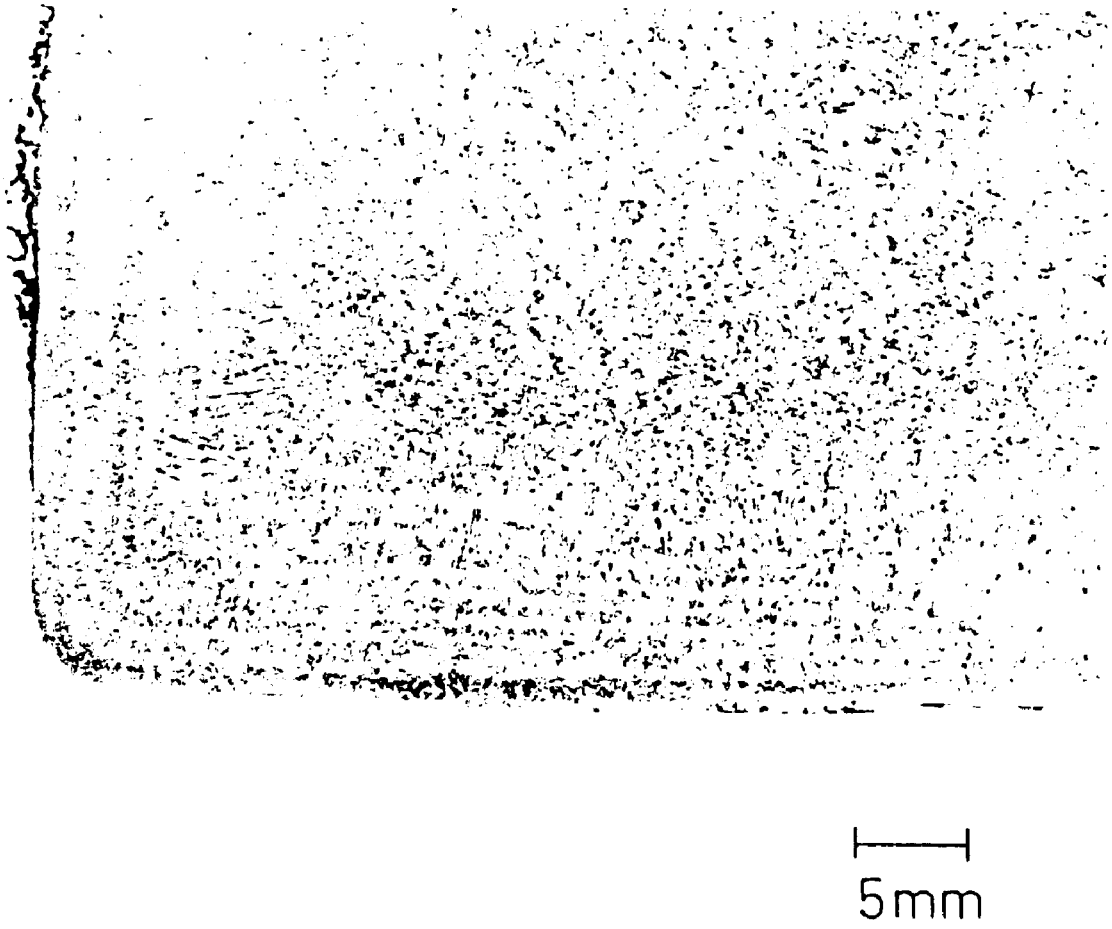
FIG. 9 is a metallograph showing a clear corner of the negative segregation zone of FIG. 8.

As shown in FIGS. 8(*a*), 8(*b*) and 9, thin negative segregation zones of a multilayer structure are uniformly generated along the outer circumference of a cast slab at the same distance from the cast slab surface corresponding to the period of stirring. Accordingly, cracks can be prevented from proceeding on the cast slab surface, and further the oxidation of a grain boundary can be suppressed. In addition to that, a growing direction of prismatic crystals (dendrite)

in a positive segregation zone located between the negative segregation zones is alternately changed for each positive segregation zone. Accordingly, compared with a cast slab in which prismatic crystals (dendrite) grow in one direction, the solidification structure is strong with respect to the occurrence of cracks. For the above reasons, it is possible to produce a cast slab, the surface layer of which has a highly enhanced function, by the casting method of the present invention.

Next, a coefficient of acceleration time will be explained below. When consideration is given to a material point in a liquid state, concerning a material point movement, it can be said as follows by the law of dynamics. "Concerning a momentum of a material point in a predetermined period of time, its change is equal to an impulse of an acting force and a period of time in which the force acts." Therefore, it is possible to apply the law to a change in the acting force in a vibrating condition. That is, (acceleration×acceleration time), which is a coefficient of acceleration time defined by the present invention, can be used as a parameter of vibration, that is, (acceleration×acceleration time) can express a change in the impulse or acting force which represents a state of vibration. Due to the foregoing, it is possible to control a state of vibration by adjusting a holding time (t2, t4) in the melting condition and an acceleration giving time (t1, t3) while the coefficient of acceleration time is used as a parameter.

In order to provide a stable effect, vibration of the present invention, which reciprocates on the front solidified shell, has an appropriate period. An upper and a lower limit of the appropriate period are determined as follows.

In order to give an acceleration uniformly in the circumferential direction of a cast slab, it is necessary to invert the accelerating direction in a period of time in which a boundary layer on the front solidified shell is not peeled off. This period of time is shorter than 5 seconds and was found by an experiment, and a vibrating time of one period, which will be referred to as a vibrating period hereinafter, is shorter than 10 seconds.

On the other hand, in order to exhibit the effect of vibration in the casting direction of a cast slab, it is necessary to give at least one period of vibration while the cast slab is passing through the core portion of the electromagnetic coil. At this time, a period of vibration is not more than a value of (core length)/(casting speed). Therefore, the upper limit of the vibration period is determined by a condition in which casting operation can be stabilized in both the circumferential direction of the cast slab and the casting direction. The shorter of the periods becomes the upper limit of the vibration period.

The present inventors found the following. Molten steel on the front solidified shell is accelerated in vibration when the condition of (period of vibration)≧2/(frequency of electromagnetic coil) is satisfied. A frequency of the electromagnetic coil for generating a shifting magnetic field is 10 Hz at most. Therefore, a lower limit of the period of vibration is not less than 0.2 sec.

In the present invention, a flow velocity is obtained when a displacement of a reference point is differentiated by time, and an acceleration is obtained when the flow velocity is differentiated by time. The acceleration may be obtained when a flow velocity at the point of time when the flow velocity of vibration is zero is differentiated by time. Alternatively, the acceleration may be a value of (maximum vibration flow velocity−minimum vibration flow velocity)/t1 or (maximum vibration flow velocity−minimum vibration flow velocity)/t3. The reference point is located at the center of the long side of the mold or at a point distant from the front solidified shell by 20 mm in front at the ¼ width. Acceleration time of the coefficient of acceleration time is t1 or t3 up to the acceleration range t1, in which t1 is restricted by t3. An average rotation flow velocity is an average flow velocity obtained when the acceleration is multiplied by the time and integrated with respect to the total time and the thus obtained value is averaged with respect to the time. In FIG. 2, the accelerating region (t1, t3) is a high acceleration time, and the accelerating region (t2, t4), the absolute value of the acceleration of which is low, is a low accelerating region.

Next, the cast slab of the present invention will be explained below. The first characteristic of the cast slab is that the cast slab has a negative segregation zone composed of a multilayer structure, the pitch of which is not more than 2 mm and the number of the layers of which is not less than three and that the thickness of the negative segregation zone is not more than 30 mm. Concerning the negative segregation zone, there are two cases. One case is shown in FIGS. 8(*a*) and 9 in which a corner of the negative segregation zone is clear with respect to a corner of the cast slab, and the other case is shown in FIG. 8(*b*) in which a corner of the negative segregation zone is not clear with respect to a corner of the cast slab. First, in the case shown in FIG. 8(*a*), a corner point (C) of a central negative segregation line (m) is determined in an average profile of a negative segregation zone of a multilayer structure. Parallel lines which are parallel to the adjoining two sides are drawn from points (E) on the adjoining two sides distant from the corner point to the inside of the cast slab by 5 mm. A difference between the shell thickness $D_1$ at the point of intersection (F) with respect to the negative segregation line (m) and the shell thickness $D_2$ at the center in the width direction of the cast slab is prescribed to be not more than 3 mm.

In the case shown in FIG. 8(*b*), a virtual corner point (C') is determined which is extrapolated from the adjoining two sides of a central negative segregation line (m) of an arcuate negative segregation zone. Parallel lines which are parallel to the adjoining two sides are drawn from points (E) on the adjoining two sides distant from the corner point to the inside of the cast slab by 5 mm. A difference between the shell thickness $D_1$ at the point of intersection (F) with respect to the central negative segregation line (m) and the shell thickness $D_2$ at the center in the width direction of the cast slab is prescribed to be not more than 3 mm.

In the same manner, a corner point of a center line of a dendrite or a crystalline structure zone of an average profile of the dendrite or the crystalline structure zone of a deflection structure is determined, or a virtual corner point extrapolated from the adjoining two sides of the center line of the arcuate dendrite or the crystalline structure zone is determined, and a prescription is made in the same manner.

On the other hand, with respect to a circular cast slab, fluctuation of the shell thickness at a point on a central segregation line (m) of a negative segregation zone of a multilayer structure, or fluctuation of the shell thickness at a point on a central segregation line (m) of an average profile of a dendrite of a segregation structure or a crystalline structure zone is prescribed to be not more than 3 mm.

More specifically, a negative segregation zone of a multilayer structure, a dendrite of a deflection structure or a crystalline structure zone is prescribed. That is, concerning the negative segregation zone, a dendrite of a deflection structure or a crystalline structure, on the basis of a positional relation shown in FIG. 7, the cast slab comprises a negative segregation zone, a dendrite of a deflection structure or a crystalline structure zone composed of a multilayer structure formed in the inner circumferential direction of the mold having pitch P defined by the following expression (2) in a range of $D_0 \pm 15$ mm in the thickness direction with respect to solidified shell thickness $D_0$ (mm) at the core center in the casting direction determined by solidified shell thickness $D_0$ (mm) defined by the following expression (1).

$$D=k(L/V)_n \quad (1)$$

D: Solidified shell thickness

L: Length from meniscus to core center of electromagnetic coil

V: Rate of casting k: Coefficient of solidification n: Constant (0.5 to 1.0)

$$P=U\times t/2 \quad (2)$$

U: Rate of solidification (dD/dt (mm/s))

t: Period of vibration

In this connection, in the present invention, the installing position is not limited to a position inside the mold. As long as it is a position in the continuous casting machine and molten steel exists at the point, the present invention can be applied to any position in principle.

In the present invention, molten metal is not limited to a specific metal. However, the present invention will be explained here referring to the appended drawings in which the present invention is applied to steel.

EXAMPLES

Example 1

In this example, in order to make clear the influence, of a vibration pattern which is generated by an electromagnetic coil, on the equi-axed crystal ratio and the grain size of equi-axed crystals, an experiment was made in which molten steel was poured into a mold having an electromagnetic coil, the frequency of which was 10 Hz. In this experiment, molten steel of 50 kg, the carbon content of which was 0.35%, was melted in a high frequency melting furnace and poured into a mold made of copper, wherein the width of the mold was 200 mm, the length was 100 mm and the height was 300 mm. Immediately after the molten steel had been poured into the mold, the molten steel was solidified while it was being vibrated in the mold by a predetermined vibrating pattern. After the completion of casting, the ingot was cut on a lateral section, so that the solidified structure was revealed outside. Then, an area ratio of an equi-axed crystal region (an equi-axed crystal area ratio) and a diameter of an equivalent circle of the equi-axed crystal region were evaluated. The vibrating pattern was changed as follows. In FIG. 2, an electric current of the electromagnetic coil was set at 100 ampere at maximum and −100 ampere at minimum. Coil current increasing time t1 in which an one direction acceleration is given, coil current holding time t2 when coil current is kept constant, coil current decreasing time t3 in which an opposite direction acceleration is given, and minimum coil current holding time t4 were set at predetermined values. In this way, the vibrating pattern was changed.

Figure 3:
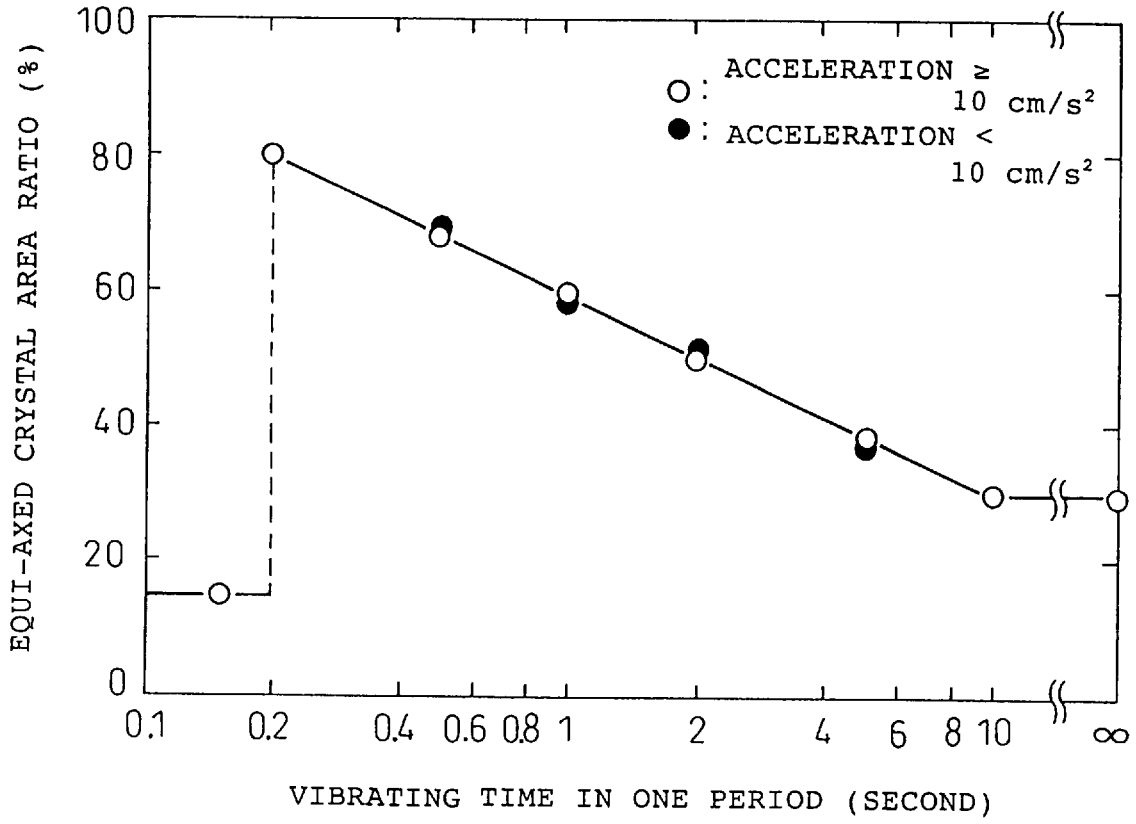
FIG. 3 is a graph showing a relation between a period of an electromagnetic coil current and an equi-axed crystal ratio.
Figure 4:
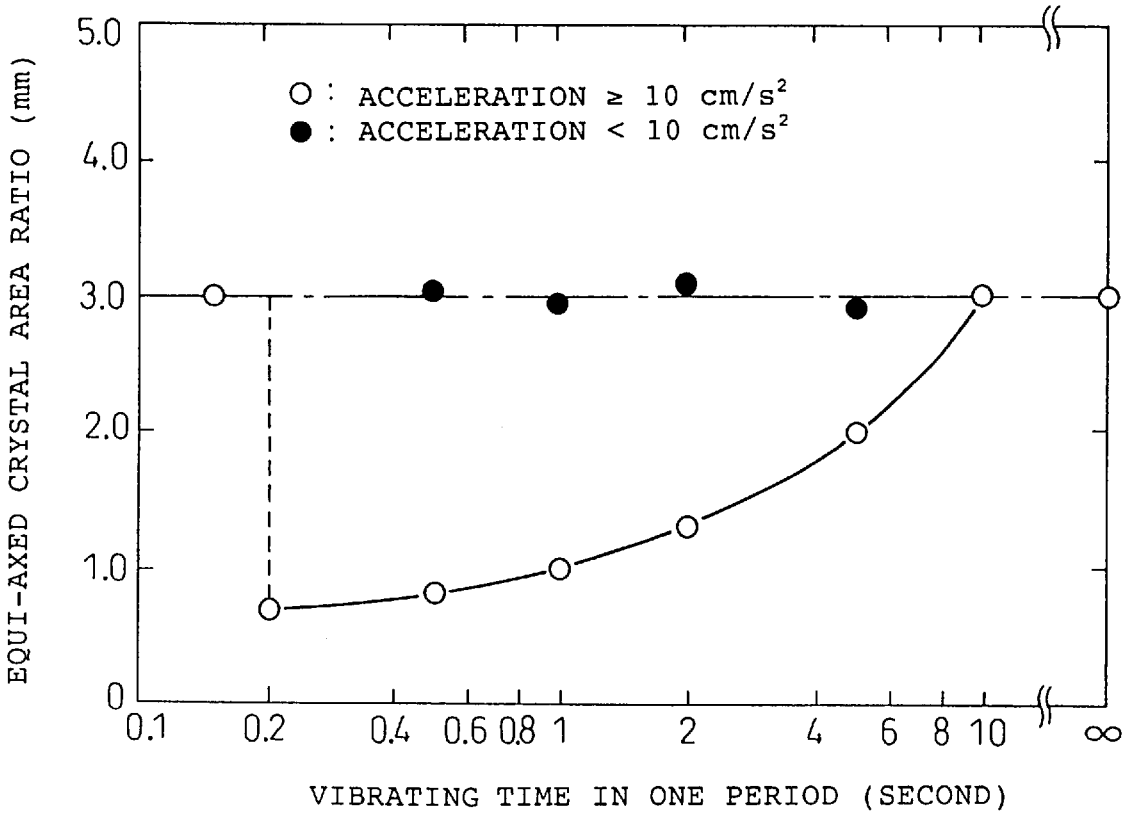
FIG. 4 is a graph showing a relation between a period of an electromagnetic coil current and an equivalent diameter of an equi-axed crystal circle.

FIG. 3 is a view showing a relation between the period of a change in the coil current (t1+t2+t3+t4) and the equi-axed crystal area ratio. When the vibrating period is reduced, the equi-axed crystal area ratio is increased. However, when the vibrating period becomes shorter than 0.2 second, the equi-axed crystal area ratio is suddenly decreased. The reason why is that the vibrating flow velocity on the front solidified shell cannot follow the coil current when the period of the coil current is decreased. FIG. 4 is a view showing a relation between the period of the electromagnetic coil current and the diameter of the equivalent circle of an equi-axed crystal region. When an absolute value of acceleration on the front solidified shell (because a value of acceleration becomes −10 cm/s$^2$ in the reverse side accelerating region) is lower than 10 cm/s$^2$, the diameter of an equivalent circle of an equi-axed crystal region does not depend upon the vibrating period. Therefore, it is impossible to obtain an effect of making the equi-axed crystals fine. However, when an absolute value of acceleration on the front solidified shell becomes a value not less than 10 cm/s$^2$, it can be understood that the equi-axed crystals are made fine at a vibrating period of shorter than 10 seconds. The reason why an effect of making the crystals fine cannot be obtained except for the above operating conditions is described as follows. When a value of acceleration of the vibrating flow velocity on the front solidified shell is lower than 10 cm/s$^2$, a force acting on the prismatic dendrite is weak, so that it is impossible to obtain an effect of making the crystals fine. When the vibrating period becomes a value not longer than 10 seconds, a boundary layer is peeled off on the front solidified shell, so that it becomes difficult for a cutting force generated by acceleration to act on the prismatic dendrite. From the above viewpoint, it can be understood that the vibrating condition for making the equi-axed crystals fine is more severe than the condition for enhancing the equi-axed crystal ratio.

As a result, the following can be understood. In order to enhance the equi-axed crystal ratio and make the grain size of the equi-axed crystals fine, the period of the electromagnetic coil current is set at a value not shorter than 0.2 sec and shorter than 10 sec, and at the same time, the absolute value of acceleration on the front face of solidification is set at a value not less than 10 cm/s$^2$.

In this connection, concerning the acceleration in the present invention, the effect depends upon the carbon content of molten steel. In the present invention, the acceleration is restricted as follows. When $C \leqq 0.1\%$, the acceleration is 30 to 300 cm/s$^2$. When $0.1\% \leqq C \leqq 0.35\%$, the acceleration is $\{80[C]+38\}$ to 300 cm/s$^2$. When $0.35\% \leqq C \leqq 0.5\%$, the acceleration is $\{133.3[C]-36.7\}$ to 300 cm/s$^2$. When $0.5\% \leqq C$, the acceleration is 30 to 300 cm/s$^2$. The reason why the upper limit is given here is that no confirmation was made in the experiment exceeding the above condition.

The above knowledge was obtained by the experiment made by the present inventors when attention was paid to a relation between the equi-axed crystal ratio and the carbon content.

Example 2

In this example, a two-strand type continuous casting machine for continuously casting billets was used, and cast billets of 120 mm square made of carbon steel, the carbon content of which was 0.35%, were cast for 30 minutes at the casting speed of 1.2 m/min. Temperature in a tundish was 1530° C. In one of the strands, conventional electromagnetic stirring was generated, in which the coil current of the electromagnetic stirring device was set at a constant value of 200 ampere and the frequency was set at 10 Hz, for 30 minutes at the flow velocity of 60 cm/s. In the other strand, an electromagnetic coil of the present invention capable of giving vibration was arranged in the mold, and molten steel on the front solidified shell was vibrated under the following conditions. Vibration time of one period of the coil current was 2 s (the maximum coil current was 200 ampere, the minimum coil current was −200 ampere, the coil current increasing time was 0.8 s, the coil current decreasing time was 0.8 s, the maximum coil current holding time was 0.2 s, and the minimum coil current holding time was 0.2 s), and acceleration in the one direction and the opposite direction was given under the condition of 50 cm/s$^2$ as shown in FIG. 2. After a lateral section of the cast billet had been cut and the solidified structure had been revealed, the equi-axed crystal area ratio and the diameter of the equivalent circle of an equi-axed crystal region were evaluated. Concerning the surface quality of the cast billets, the cast slabs were subjected to a visual inspection line, so that each billet was visually inspected, and the number of defects caused by powder was investigated.

Concerning the billets on which the conventional electromagnetic stirring was conducted, the equi-axed crystal ratio was 30%, and the diameter of the equivalent circle of an equi-axed crystal region was 3.0 mm. The flow velocity of molten steel was 60 cm/s, which exceeded a critical flow velocity of powder trapping. Therefore, powder on the surface of molten steel was trapped, and the defects were caused by powder, the number of which was 5 pieces/billet. Further, there was formed a negative segregation zone, the width of which was approximately 20 mm, on the surface layer side of the lateral section of the cast billet. On the other hand, when vibration was given by the electromagnetic coil of the present invention, the equi-axed crystal area ratio of the cast billet was 50%, and the diameter of the equivalent circle of an equi-axed crystal region was 1.3 mm. Therefore, compared with the conventional electromagnetic stirring, not only the equi-axed crystal area ratio was enhanced, but also the grain size of the equi-axed crystals was made fine. Since the molten steel on the front face of solidification in the mold was vibrated, powder trapping was not caused, and defects originated from powder were not caused. On the lateral face of the cast billet, a negative segregation zone of a multilayer, the pitch of which was 1.5 mm, was formed on the surface layer of 15 mm, and also a dendrite of deflection structure of a multilayer was formed.

Example 3

Figure 5:
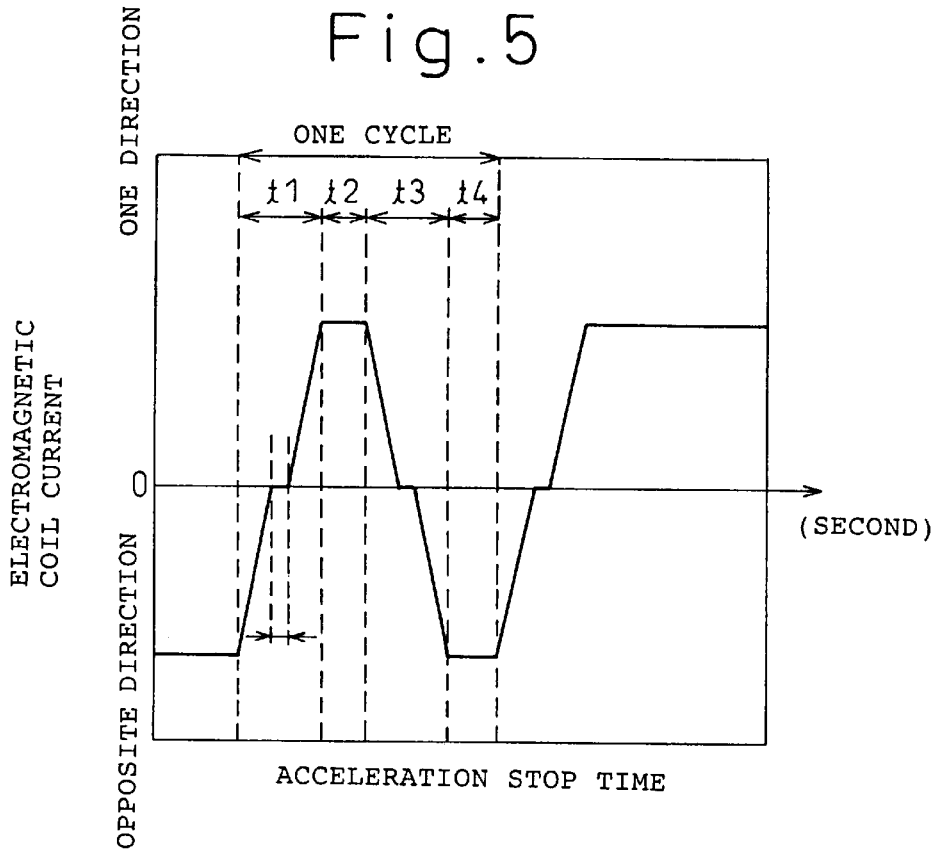
FIG. 5 is a diagram showing an example in which an acceleration stop time is provided, the period of which is not more than 0.3 sec and not less than 0.03 sec during one direction and the opposite direction.

In this example, a two-strand type continuous casting machine for continuously casting slabs was used, and cast pieces of 250 mm thickness×1500 mm width made of carbon steel, the carbon content of which was 0.35%, were cast for 30 minutes at the casting speed of 1.8 m/min. Temperature in a tundish was 1550° C. In one of the strands, a conventional electromagnetic stirring was generated, in which the coil current of the electromagnetic stirring device was set at a constant value of 500 ampere and the frequency was set at 2 Hz, for 30 minutes at the flow velocity of 60 cm/s. In the other strand, an electromagnetic coil of the present invention capable of giving stirring was arranged in the mold. For 15 minutes in the first half of casting, molten steel on the front face of solidification was vibrated under the following conditions. Vibrating time of one period of the coil current was 2 s (the maximum coil current was 400 ampere, the minimum coil current was −400 ampere, the coil current increasing time was 0.8 s, the coil current decreasing time was 0.8 s, the maximum coil current holding time was 0.2 s, and the minimum coil current holding time was 0.2 s), and acceleration in the one direction and the opposite direction was given under the condition of 70 cm/s$^2$ as shown in FIG. 2. For 15 minutes in the second half of casting, the molten steel on the front solidified shell was vibrated under the following conditions. Vibrating time of one period of the coil current was 2.1 s (the maximum coil current was 400 ampere, the minimum coil current was −400 ampere, the coil current increasing time was 0.8 s, the coil current decreasing time was 0.8 s, the maximum coil current holding time was 0.2 s, and the minimum coil current holding time was 0.2 s), the acceleration stop time was 0.05 s in the acceleration in the one direction and opposite direction, and acceleration in the one direction and the opposite direction was given under the condition of 50 cm/s$^2$ as shown in FIG. 5. After a lateral section of the cast slab had been cut and the solidified structure had been exposed, the equi-axed crystal area ratio and the diameter of the equivalent circle of an equi-axed crystal region were evaluated. Concerning the surface quality of the cast slabs, the cast slabs were subjected to a visual inspection line, so that each slab was visually inspected, and the number of defects caused by powder was investigated. Since vibration marks on the slab surface correspond to a shape of the meniscus, a difference in the levels of the vibration marks was investigated at the same time.

Concerning the slabs on which the conventional electromagnetic vibration was generated, the equi-axed crystal ratio was 30%, and the diameter of the equivalent circle of an equi-axed crystal region was 3.0 mm. The flow velocity of molten steel was 60 cm/s, which exceeded a critical flow velocity of powder trapping. Therefore, powder on the surface of molten steel was trapped, and the defects were caused by powder, the number of which was 5 pieces/slab. Further, since the meniscus fell into disorder, the difference in the levels of the vibration marks was 3.5 mm. Furthermore, there was formed a negative segregation zone, the width of which was 20 mm, on the surface layer side of the lateral section of the slab.

On the other hand, when vibration was given by the electromagnetic coil of the present invention, irrespective of the existence of the acceleration stop time, the equi-axed crystal area ratio of the slab was 50%, and the diameter of the circle equivalent to the equi-axed crystal region was 1.3 mm. Therefore, the equi-axed crystal area ratio of this example was superior to that of the conventional electromagnetic stirring, and further the grain size of the equi-axed crystals was made fine. Further, since the molten steel on the front face of solidification in the mold was vibrated, no powder trapping was caused, and no defects originated from powder were caused. On the lateral section of the cast slab, a negative segregation zone of a multilayer, the pitch of which was 1.5 mm corresponding to the period of vibration, was formed on the surface layer of 15 mm, and also a dendrite of deflection structure of a multilayer was formed. Concerning the vibration mark, in the case of a slab in which the acceleration stop time was not provided, the vibration mark was 5 mm, and in the case of a slab in which the acceleration stop time was provided, the vibration mark was 3 mm. In both cases, the shape of the meniscus was made uniform compared with that of the conventional electromagnetic stirring. However, when the acceleration stop time was provided, the meniscus was made more uniform. The reason is that a sudden acceleration was reduced when the acceleration stop time was provided, so that the meniscus was made uniform. In the present invention, the acceleration stop time was set to be not more than 0.3 sec and not less than 0.03 sec. The reason is described as follows. When the acceleration stop time is set to be more than 0.3 sec, an effect of acceleration is deteriorated, and when the acceleration stop time is set to be less than 0.03 sec, it becomes impossible to make the meniscus uniform.

Example 4

Figure 6:
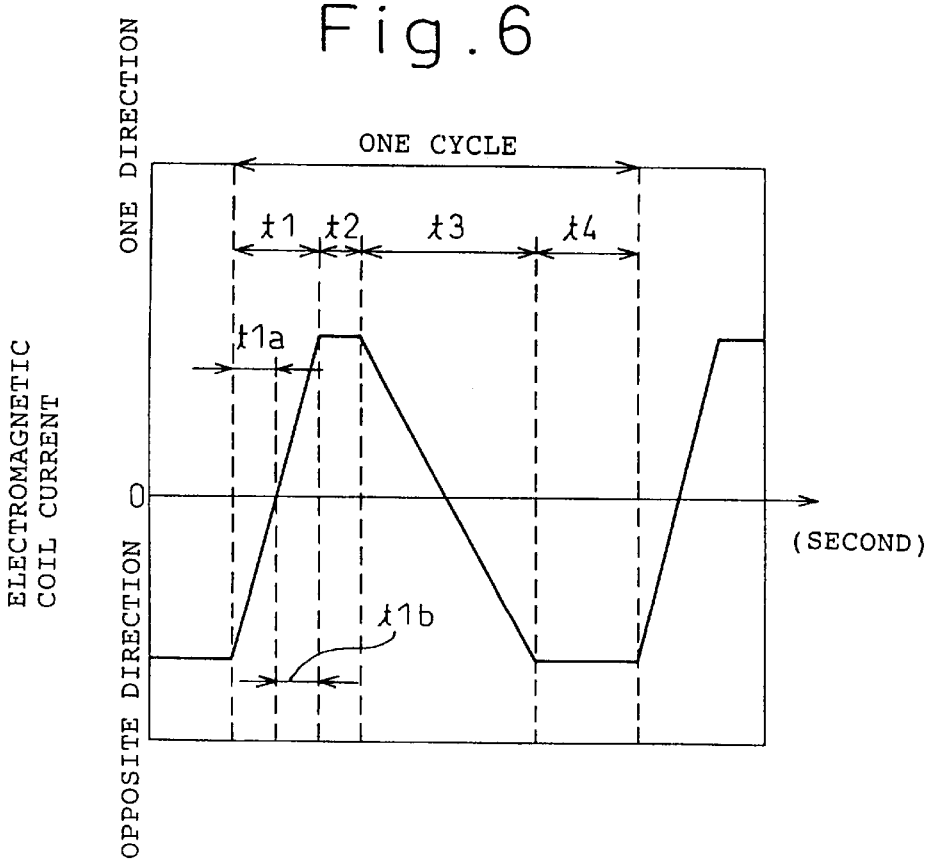
FIG. 6 is a diagram showing an example in which an acceleration in the one direction is 100 $cm/s^2$ and an acceleration in the opposite direction is 50 $cm/s^2$.

In this example, a two-strand type continuous casting machine for continuously casting slabs was used, and cast slabs of 250 mm thickness×1500 mm width made of carbon steel, the carbon content of which was 0.35%, were cast for 30 minutes at the casting speed of 1.8 m/min. Temperature in a tundish was 1550° C. In one of the strands, a conventional electromagnetic stirring was conducted, in which the coil current of the electromagnetic stirring device was set at a constant value of 500 ampere and the frequency was set at 2 Hz, for 30 minutes at the flow velocity of 60 cm/s. In the other strand, an electromagnetic coil of the present invention capable of giving vibration was arranged in the mold. Molten steel on the front face of solidification was vibrated under the following conditions. Vibrating time of one period of the coil current was 2 s (the maximum coil current was 400 ampere, the minimum coil current was −400 ampere, the coil current increasing time was 0.4 s, the coil current decreasing time was 0.8 s, the maximum coil current holding time was 0.3 s, and the minimum coil current holding time was 0.5 s), and acceleration in the normal direction was set at 100 cm/s$^2$, and acceleration in the opposite direction was set at 50 cm/s$^2$ as shown in FIG. 6. After a lateral section of the cast slab had been cut and the solidified structure had been revealed, the equi-axed crystal area ratio and the diameter of the equivalent circle of an equi-axed crystal region were evaluated. Concerning the surface quality of the cast slabs, the cast slabs were subjected to a visual inspection line, so that each slab was visually inspected, and the number of defects caused by powder was investigated. In addition to that, a microscopic examination was made for checking the number of pieces of inclusion on the surface layer of the slab.

Concerning the slabs on which the conventional electromagnetic stirring was conducted, the equi-axed crystal ratio was 28%, and the diameter of the equivalent circle of an equi-axed crystal region was 3.1 mm. The flow velocity of molten steel was 60 cm/s, which exceeded a critical flow velocity of powder trapping. Therefore, powder on the surface of molten steel was trapped, and the defects were caused by powder, the number of which was 6 pieces/slab. Further, there was formed a negative segregation zone, the width of which was approximately 20 mm, on the surface layer side of the lateral section of the cast slab.

On the other hand, when vibration and rotation according to a time difference in the normal and the reverse direction were given by the electromagnetic coil of the present invention, the equi-axed crystal area ratio of the cast slab was 55%, and the diameter of the equivalent circle of an equi-axed crystal region was 1.3 mm. Therefore, compared with the conventional electromagnetic stirring, not only the equi-axed crystal area ratio was enhanced, but also the grain size of the equi-axed crystals was made fine. Since the molten steel on the front face of solidification in the mold was vibrated, powder trapping was not caused, and defects originated from powder were not caused, either. On the lateral section of the cast slab, a negative segregation zone of a multilayer, the pitch of which was 1.5 mm, was formed on the surface layer of 15 mm, and also a dendrite of deflection structure was formed. When vibration and rotation were simultaneously given to the molten steel by the electromagnetic coil, the prismatic dendrite was more effectively cut apart. Therefore, compared with Example 3 in which only vibration was given to the molten steel, the equi-axed crystal ratio was enhanced in this example. In this connection, when rotation is added to vibration conducted in the molten steel, powder trapping can be suppressed by vibration, however, when a flow velocity of rotation exceeded 1 m/s, powder trapping was caused. Therefore, the flow velocity of rotation was restricted to be not more than 1 m/s.

Example 5

In this example, a two-strand type continuous casting machine for continuously casting slabs was used, and cast slabs of 250 mm thickness×1500 mm width made of carbon steel, the carbon content of which was 0.35%, were cast for 30 minutes at the casting speed of 1.8 m/min. Temperature in a tundish was 1550° C. In one of the strands, the conventional electromagnetic stirring was conducted, in which the coil current of the electromagnetic stirring device was set at a constant value of 500 ampere and the frequency was set at 2 Hz, for 30 minutes at the flow velocity of 60 cm/s. In the other strand, the electromagnetic coil of the present invention capable of giving vibration was arranged in the mold. Molten steel on the front face of solidification was vibrated under the following conditions. Vibrating time of one period of the coil current was 2 s (the maximum coil current was 400 ampere, the minimum coil current was −400 ampere, the coil current increasing time was 0.8 s, the coil current decreasing time was 0.8 s, the maximum coil current holding time was 0.2 s, and the minimum coil current holding time was 0.2 s), and acceleration in the one direction and the opposite direction was set at 50 cm/s$^2$ as shown in FIG. 2. While the molten steel on the front face of solidification was being vibrated, a magnetic force was applied upon the molten steel by a static magnetic filed, the magnetic field intensity of which was 3000 gauss, by an electromagnetic brake arranged at a position lower than the meniscus by 1 m. After a lateral section of the cast slab had been cut and the solidified structure had been revealed, the equi-axed crystal area ratio and the diameter of the equivalent circle of an equi-axed crystal region were evaluated. Concerning the surface quality of the cast slabs, the cast slabs were subjected to a visual inspection line, so that each slab was visually inspected, and the number of defects caused by powder was investigated.

Concerning the slabs on which the conventional electromagnetic stirring was generated, the equi-axed crystal ratio was 31%, and the diameter of the equivalent circle of an equi-axed crystal region was 2.9 mm. The flow velocity of molten steel was 60 cm/s, which exceeded a critical flow velocity of powder trapping. Therefore, powder on the surface of molten steel was trapped, and the defects were caused by powder, the number of which was 4 pieces/slab. Further, there was formed a negative segregation zone, the width of which was approximately 20 mm, on the surface layer side of the lateral section of the cast slab. On the other hand, when vibration was given by the electromagnetic coil of the present invention and the electromagnetic brake was applied, the equi-axed crystal area ratio of the cast slab was 56%, and the diameter of the equivalent circle of an equi-axed crystal region was 1.3 mm. Therefore, compared with the conventional electromagnetic stirring, not only the equi-axed crystal area ratio was enhanced, but also the grain size of the equi-axed crystals was made fine. Since the molten steel on the front solidified shell in the mold was vibrated, powder trapping was not caused, and defects originated from powder were not caused, either. On the lateral section of the cast slab, a negative segregation zone of a multilayer, the pitch of which was 1.5 mm, was formed on the surface layer of 15 mm, and also a dendrite of deflection structure was formed. When vibration caused by the electromagnetic coil was given together with the electromagnetic brake, the equi-axed crystal ratio was enhanced as compared with that in Example 3 in which only vibration was given. The reason why the equi-axed crystal ratio was enhanced is that permeation of molten steel of high temperature into the inside of a cast slab was prevented by the electromagnetic brake, and the tesseral crystal cores, which had been generated by vibration of the electromagnetic coil, were prevented from being remelted. In this connection, when the acceleration stop time is provided in the vibration generated by the electromagnetic coil, it is unnecessary to apply the electromagnetic brake continuously, that is, it is possible to impress the electromagnetic brake synchronously with the acceleration stop time.

INDUSTRIAL APPLICABILITY

As described above, according to the method of the present invention in which the vibration pattern is adjusted by the electromagnetic coil so as to give vibration to molten metal, it is possible to give a strong force onto the front solidified shell. Accordingly, compared with the conventional method, not only the equi-axed crystals can be increased but also the grain size of the equi-axed crystals can be made fine. Due to the above effects, it is unnecessary to increase the flow velocity too high for making the solidified structure fine. Therefore, it is possible to prevent the occurrence of surface defects caused by powder trapping.

In this connection, when the present invention is applied to a stationary mold, the inner structure of conventional material can be remarkably improved. Accordingly, the productivity and cost can be improved.

What is claimed is:

1. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction at not lower than 10 $cm/s^2$;

accelerating low intensity vibrating waves in the one direction and the opposite direction at lower than 10 $cm/s^2$.

2. A method for casting molten metal according to claim 1 further comprising:

providing a coefficient of acceleration time (acceleration× acceleration time) for vibrating waves in the one direction or vibrating waves in the opposite direction satisfying the expression: 50 cm/s≦coefficient of acceleration time.

3. A method for casting molten metal according to claim 1 further comprising:

providing a coefficient of acceleration time (acceleration× acceleration time) for vibrating waves in the one direction or vibrating waves in the opposite direction satisfying the expression: 10η≦coefficient of acceleration time, wherein η: viscosity, centipoises, of the molten metal.

4. A method for casting molten metal according to claim 1 further comprising:

providing a relationship between carbon content C and acceleration satisfying the following expressions:

$$[C]<0.1\%: 30\ cm/s^2 \leqq \text{acceleration}$$

$$0.1\% \leqq [C]<0.35\%: -80[C]+38\ cm/s^2 \leqq \text{acceleration}$$

$$0.35\% \leqq [C]<0.5\%: 133.3[C]-36.7\ cm/s^2 > \text{acceleration}$$

$$0.5\% \leqq [C]: 30\ cm/s^2 \leqq \text{acceleration}.$$

5. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

providing an acceleration stop time or an electric power stop time having a period which is not more than 0.3 sec. and not less than 0.03 sec. in the steps of accelerating in the one direction and accelerating in the opposite direction.

6. A method for casting molten metal according to claim 1 further comprising:

providing an acceleration stop time or an electric power stop time having a period which is not more than 0.3 sec. and not less than 0.03 sec. in the steps of accelerating in the one direction and accelerating in the opposite direction.

7. A method for casting molten metal according to claim 1 further comprising:

generating acceleration in the one direction for t1;

subsequently, maintaining a constant flow velocity for t2;

next, generating acceleration in the opposite direction for t3;

thereafter, maintaining a constant flow velocity for t4;

defining t1, t2, t3 and t4 as one period;

periodically vibrating said molten metal by repeating the period t1, t2, t3 and t4;

providing a vibration time t1+t2+t3+t4 in one period of not less than 0.2 sec. and less than 10 sec.

8. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

providing means for periodically changing acceleration of the molten metal, and providing a rotating flow to the molten metal in the one direction and the opposite direction;

generating integration for a certain period of time;

satisfying a condition of integrated value of (acceleration time×acceleration) in the one direction>integrated value of (acceleration time×acceleration) in the opposite direction;

causing an average rotating flow velocity of the molten metal by a difference between the integrated values of not more than 1 m/s.

9. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

generating acceleration in the one direction for t1;

subsequently, maintaining a constant flow velocity for t2;

next, generating acceleration in the opposite direction for t3;

thereafter, maintaining a constant flow velocity for t4;

defining t1, t2, t3 and t4 as one period;

periodically vibrating said molten metal in the mold by repeating the period t1, t2, t3 and t4;

defining t1*a* as a time until vibrating flow velocity becomes zero in time t1;

defining t1*b* as a time after vibrating flow velocity becomes zero in time t1;

satisfying a condition of t1*b*+t2>t4+t1*a;* causing a rotating flow velocity by a difference in time between t1*b*+t2 and t4+t1*a* being not more than 1 m/s.

10. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

periodically vibrating the molten metal in a period of n cycles;

generating a rotating flow by accelerating only in a predetermined direction for a rotating time ΔTv after vibration;

satisfying following expressions for average rotating flow velocity, number n of cycles, and rotating time ΔTv:

average rotating flow velocity≦1 m/s,

1≦number n of cycles≦20, 0.1≦rotating time $\Delta Tv$≦5 sec.

11. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

generating a rotating flow by increasing acceleration in the one direction to be larger than acceleration in the opposite direction;

providing an average rotating flow of not more than 1 m/s.

12. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

providing an electric current for generating a rotating flow in the one direction;

further superimposing the electric current for generating the rotating flow in the one direction during vibration with an electric current of the electromagnetic coil for generating the shifting magnetic field thereby providing an average rotating flow velocity of not more than 1 m/s.

13. A method for casting molten metal comprising the steps of:

pouring molten metal into a mold;

applying an electromagnetic force upon the molten metal in the mold, said electromagnetic force being generated by an electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in one direction and an opposite direction;

accelerating low intensity vibrating waves in the one direction and the opposite direction;

providing means for periodically changing acceleration of said molten metal;

adding vibration of a short period;

providing a frequency of the vibration of the short period of not less than 100 Hz and not more than 30 kHz.

14. A method for casting molten metal according to claim 1 further comprising:

providing means for periodically changing acceleration;

providing an electromagnetic brake arranged in a range from a meniscus of the molten metal to a position under the mold distant by 1 m;

applying the electromagnetic brake.

15. A method for casting molten metal according to claim 6 further comprising:

providing means for periodically changing acceleration of the molten metal;

providing an electromagnetic brake arranged in a range from a meniscus of the molten metal to a position under the mold distant by 1 m;

applying the electromagnetic brake synchronized with a time at which acceleration by the electromagnetic coil is stopped or synchronized with a time at which an electric power source is stopped.

16. A method for casting molten metal according to claim 1 further comprising:

arranging the electromagnetic coil for providing the electromagnetic field in the molten metal pool in the mold in a range under the mold from right below the mold to a distance under the mold of 10 m.

17. A method for casting molten metal according to claim 16 further comprising:

arranging an electromagnetic brake in a range from a position 1 m above the electromagnetic coil to a position 1 m below the electromagnetic coil.

18. A method for casting molten metal according to claim 6 further comprising:

arranging the electromagnetic coil for providing the electromagnetic field in the molten metal pool in the mold in a range under the mold from a position right below the mold to a position 10 m under the mold;

providing an electromagnetic brake arranged in a range from a meniscus of a molten metal to a position under the mold distant by 1 m;

applying the electromagnetic brake synchronized with a time at which acceleration by the electromagnetic coil is stopped or synchronized with a time at which an electric power source is stopped.

19. A method for casting molten metal according to claim 1, further comprising an electromagnetic coil device that comprises an electromagnetic drive device for vibrating molten metal in a molten metal pool in one direction and an opposite direction by periodically changing current in the electromagnetic coil; and a control unit for controlling the electromagnetic drive device;

said electromagnetic coil device used in a method for casting molten metal comprising:

pouring the molten metal into a mold;

applying an electromagnetic force upon the molten metal in the mold, said electromagnetic force being generated by the electromagnetic coil arranged for providing an electromagnetic field in the molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in the one direction and the opposite direction;

accelerating low intensity vibrating waves in the one direction and the opposite direction.

20. A method for casting molten metal according to claim 1, further comprising an electromagnetic coil device that comprises an electric power source for supplying an electric current to the electromagnetic coil or a wave form generating device to vibrate molten metal in a molten metal pool in one direction and an opposite direction by periodically changing electromagnetic current in the electromagnetic coil;

said electromagnetic coil device used in a method for casting molten metal comprising:

pouring the molten metal into a mold;

applying an electromagnetic force upon the molten metal in the mold, said electromagnetic force being generated by the electromagnetic coil arranged for providing an electromagnetic field in the molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in the one direction and the opposite direction;

accelerating low intensity vibrating waves in the one direction and the opposite direction.

21. A method for casting molten metal according to claim 1, further comprising an electromagnetic coil device that comprises an electromagnetic drive device for vibrating molten metal in one direction and an opposite direction by means for periodically changing acceleration of said molten metal, the electromagnetic drive device having a function of raising an electric current to a command value in the case of changing a vibrating direction; and an electric current control device for controlling the electric current;

said electromagnetic coil device used in a method for casting molten metal comprising:

pouring the molten metal into a mold;

applying an electromagnetic force upon the molten metal in the mold, said electromagnetic force being generated by the electromagnetic coil arranged for providing an electromagnetic field in a molten metal pool in the mold;

vibrating the molten metal which is being solidified in the mold by cooling by being drawn out downward from the mold;

said vibrating being caused by a shifting magnetic field generated by the electromagnetic coil so that said molten metal is alternately given a high intensity and a low intensity of acceleration;

accelerating high intensity vibrating waves in the one direction and the opposite direction;

accelerating low intensity vibrating waves in the one direction and the opposite direction.

* * * * *